US006164821A

United States Patent [19]

Randall

[11] Patent Number: 6,164,821

[45] **Date of Patent: *Dec. 26, 2000**

[54] FLEXIBLE, SELF-SUPPORTING STORAGE BAG WITH HINGED, FRAMED CLOSURE

[75] Inventor: Catherine Jean Randall, Cincinnati, Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/854,247

[22] Filed: May 9, 1997

[51] Int. Cl.[7] ..... B65D 33/02

[52] U.S. Cl. ..... 383/34; 150/120; 383/33; 383/93; 383/104; 383/120

[58] Field of Search ..... 150/120; 190/107; 383/33, 34, 120, 93, 104

[56] References Cited

U.S. PATENT DOCUMENTS

| | | | |
|---|---|---|---|
| 584,555 | 6/1897 | Lorenz . | |
| 605,343 | 6/1898 | Ross . | |
| 2,457,422 | 12/1948 | Warner | 383/120 X |
| 2,573,309 | 10/1951 | Chipkevich . | |
| 2,647,550 | 8/1953 | Cannon | 383/120 X |
| 2,951,765 | 9/1960 | Robson . | |
| 2,986,477 | 5/1961 | Eichel . | |
| 3,197,062 | 7/1965 | Day et al. . | |
| 3,205,530 | 9/1965 | Van Buren, Jr. | 150/120 X |
| 3,306,492 | 2/1967 | Kugler . | |
| 3,319,684 | 5/1967 | Calhoun . | |
| 3,326,258 | 6/1967 | Stucker | 383/34 X |
| 3,462,067 | 8/1969 | Shore . | |
| 3,682,372 | 8/1972 | Rodley . | |
| 3,738,565 | 6/1973 | Ackley et al. . | |

(List continued on next page.)

FOREIGN PATENT DOCUMENTS

| | | | |
|---|---|---|---|
| 1047064 | 12/1953 | France | 383/33 |
| 252402 | 10/1989 | Japan | 383/34 |

*Primary Examiner*—Stephen K. Cronin
*Assistant Examiner*—Robin Hylton
*Attorney, Agent, or Firm*—W. Scott Andes; Leonard W. Lewis; Larry L. Huston

[57] ABSTRACT

A flexible storage bag comprising at least one sheet of flexible sheet material assembled to form a semi-enclosed container having an opening defined by a hinged peripheral flange. The hinged flange includes a closure means for sealing the opening to convert the semi-enclosed container to a closed container. The bag includes at least one pair of opposed gussets formed in the sheet material extending in a direction normal to the opening and a substantially planar bottom extending in a direction substantially parallel to the opening. When the bottom is placed on a horizontal surface the container is self-supporting and maintains the opening in an open condition. The present invention also provides a flexible storage bag having an opening and a closure means for sealing the opening to convert the semi-enclosed container to a closed container. The closure means comprises a strip of material forming at least a portion of the periphery of the opening having a first side facing inwardly toward the opening and a second side facing outwardly of the opening. The first side exhibits an adhesion peel force after activation by a user which is greater than an adhesion peel force exhibited prior to activation by a user. Accordingly, the flexible storage bags of the present invention combine the desirable qualities of both flexible bags and storage containers and minimize the less desirable qualities of both approaches by providing improved sealability, facilitating venting of trapped air before closure, being self-supporting in an open condition for filling, storing easily by folding into a compact form and being unitarily constructed from inexpensive materials to promote disposability and obviate the need for separate closure devices.

15 Claims, 3 Drawing Sheets

U.S. PATENT DOCUMENTS 3,756,300 9/1973 Nalle, Jr. ..... 383/34 X
3,784,055 1/1974 Anderson .
3,806,984 4/1974 Hilsabeck ..... 383/34 X
3,819,043 6/1974 Harrison .
3,970,241 7/1976 Hanson .
4,131,195 12/1978 Worrell, Sr. .
4,134,322 1/1979 Lillibridge .
4,185,754 1/1980 Julius .
4,258,538 3/1981 Morse ..... 383/120 X
4,411,374 10/1983 Hotchkiss .
4,420,080 12/1983 Nakamura .
4,458,810 7/1984 Mahoney .
4,487,318 12/1984 Roen .
4,540,091 9/1985 Haböck .
4,571,337 2/1986 Cage et al. .
4,681,240 7/1987 Wyant .
4,735,317 4/1988 Sussman et al. .
4,736,450 4/1988 Van Erden et al. .
4,790,436 12/1988 Nakamura .
4,808,421 2/1989 Mendenhall et al. .
4,832,507 5/1989 Herrington .
4,833,862 5/1989 Bortolani et al. .
4,848,930 7/1989 Williams et al. .
4,863,064 9/1989 Dailey, III .
4,898,477 2/1990 Cox et al. .
4,930,644 6/1990 Robbins, III .
4,979,613 12/1990 McLaughlin et al. .
5,044,774 9/1991 Bullard et al. .
5,048,718 9/1991 Nakamura .
5,050,737 9/1991 Joslyn et al. .
5,061,500 10/1991 Mendenhall .
5,076,436 12/1991 Bortolani et al. .
5,145,091 9/1992 Meyers .
5,195,829 3/1993 Watkins et al. .
5,201,164 4/1993 Kaufman .
5,236,576 8/1993 Zuege ..... 383/120 X
5,242,057 9/1993 Cook et al. .
5,314,252 5/1994 Happ .
5,364,189 11/1994 Kuge et al. .
5,379,897 1/1995 Muckenfuhs et al. .
5,507,579 4/1996 Sorenson .
5,524,990 6/1996 Buck .
5,547,284 8/1996 Imer .
5,575,747 11/1996 Dais et al. .
5,605,594 2/1997 May .
5,662,758 9/1997 Hamilton et al. ..... 156/221

FLEXIBLE, SELF-SUPPORTING STORAGE BAG WITH HINGED, FRAMED CLOSURE

FIELD OF THE INVENTION

The present invention relates to flexible storage bags, particularly those suitable for use in the containment and protection of various items including perishable materials. The present invention further relates to such flexible storage bags having improved sealability for containment and protection of items contained within under a wide range of in-use conditions.

BACKGROUND OF THE INVENTION

Flexible storage bags for use in the containment and protection of various items, as well as the preservation of perishable materials such as food items, are well known in the art. Such bags typically comprise a rectangular sheet of polymeric film folded upon itself and sealed along two edges to form a semi-enclosed container having two flexible opposed sidewalls, three sealed or folded edges, and one open edge. A closure integrally formed with the bag such as an interlocking rib-type seal or separately provided such as a plastic or paper-clad-wire tie completes the containment assembly.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible storage bags of the foregoing variety are typically formed from polymeric film, such as polyethylene or other members of the polyolefin family, in thicknesses of between about 0.0002 inches to about 0.002 inches. Such films are frequently transparent but sometimes are opaque and/or colored.

Flexible storage bags of the currently commercially available variety provide a means of conveniently storing a wide range of objects and materials in a generally disposable containment device. While flexible storage bags of the foregoing variety have enjoyed a fair degree of commercial success, their reliance upon mechanical closures tends to cause difficulty in operation for individuals having impaired manual dexterity such as children, the elderly, arthritis patients, etc. Moreover, such mechanical closures typically require alignment of mechanical elements for operation which can prove challenging for those with impaired vision or impaired hand-eye coordination. Many mechanical closure mechanisms also provide leakage sites at such locations as the end of interlocking channels where liquid or gases can leak into or out of the bag.

In an attempt to address this issue alternative closure mechanisms have been developed which rely upon strips or regions of adhesive to bond superimposed regions of the bag. While these closures address some of the difficulties in utilizing separate closure elements or interlocking mechanical elements, some adhesive closure mechanisms require removable liners to protect the adhesive from premature activation, thus adding additional elements for assembly and an additional activation step before use. Moreover, some protected adhesive configurations require interlocking grooves, channels, or protrusions which must be properly registered to engage the adhesive, thus again raising the visual and coordination requirements of conventional mechanical closure mechanisms.

While such flexible storage bags are generally highly efficient for storage before use, for many storage situations it is desirable to minimize the amount of air and/or free space above or around the contents which is trapped within the bag after closure to minimize storage space of filled bags and to aid the effectiveness of the bag in preservation of perishable items. Notwithstanding the type of closure mechanism employed, it is often difficult with conventional flexible storage bags to only partially close the bag and expel trapped air before completing the closure as this again requires a certain amount of manual dexterity and visual aptitude.

Conventional flexible storage bags also create an inherent challenge in terms of being able to hold the flexible or flaccid bag in an open condition with at most one hand so that the other hand can manipulate another container to pour the contents into the bag or peel, cut, or trim items for insertion into the bag. It is also difficult to maintain the proper (usually upright) orientation of the opening of the bag during such filling operations. While rigid containers and flaccid containers with reinforced opening perimeters have been developed for such uses, their comparatively higher cost and limited economical disposability leave room for improvement. Notwithstanding the issue of maintaining the container or bag opening in an open condition, there also remains a need for a flexible yet self-standing container with the foregoing attributes to facilitate easy hands-free filling. Flexible storage bags on the other hand which are constructed of more inexpensive materials to promote disposability typically lack the structure necessary for stable stacking of bags after filling.

With regard to rigid or semi-rigid containers, it is well recognized that such containers have also realized a fair degree of commercial success in providing a means for storing a wide variety of contents. Such containers typically have an opening which maintains an open condition for filling and are typically self-supporting with the opening in the proper orientation for filling. Such containers also are frequently provided with flat bottoms and tops to provide stackability. However, such containers are typically constructed of more expensive materials such that disposability is limited. At the same time, the useful life of such containers is limited by damage, soiling, or other degradation naturally occurring in use, including degradation of the typical mechanical closure mechanisms. Storage of such three-dimensional, rigid or semi-rigid containers when empty is also a concern, since they occupy as much volume empty as they do in a filled condition. Due to their comparatively fixed-volume construction, it is also difficult to minimize the amount of air or free space above or around the contents to minimize storage space of filled containers and to aid the effectiveness of the container in preservation of perishable items. Another concern is the task of matching usually-separate lids or closures with their respective containers for use.

Accordingly, it would be desirable to provide a flexible storage bag combining the desirable qualities of both flexible bags and storage containers and minimizing the less desirable qualities of both approaches.

More particularly, it would be desirable to provide a flexible storage bag having improved sealability in use.

It would also be desirable to provide a flexible storage bag which facilitates venting of trapped air before completion of closure.

It would further be desirable to provide such a bag which is capable of being self-supporting in an open condition for filling purposes, yet stores easily by folding into a compact form.

It would still further be desirable to provide a bag constructed from inexpensive materials to facilitate disposability which still promotes stable stacking of bags in a filled condition.

It would be yet further desirable to provide such a bag which provides the foregoing attributes in a convenient unitary form, obviating the need for separate closure devices.

SUMMARY OF THE INVENTION

The present invention provides a flexible storage bag comprising at least one sheet of flexible sheet material assembled to form a semi-enclosed container having an opening defined by a hinged peripheral flange. The hinged flange includes a closure means for sealing the opening to convert the semi-enclosed container to a closed container. The bag includes at least one pair of opposed gussets formed in the sheet material extending in a direction normal to the opening and a substantially planar bottom extending in a direction substantially parallel to the opening. When the bottom is placed on a horizontal surface the container is self-supporting and maintains the opening in an open condition.

The present invention also provides a flexible storage bag having an opening and a closure means for sealing the opening to convert the semi-enclosed container to a closed container. The closure means comprises a strip of material forming at least a portion of the periphery of the opening having a first side facing inwardly toward the opening and a second side facing outwardly of the opening. The first side exhibits an adhesion peel force after activation by a user which is greater than an adhesion peel force exhibited prior to activation by a user.

Accordingly, the flexible storage bags of the present invention combine the desirable qualities of both flexible bags and storage containers and minimize the less desirable qualities of both approaches by providing improved sealability, facilitating venting of trapped air before closure, being self-supporting in an open condition for filling, storing easily by folding into a compact form and being unitarily constructed from inexpensive materials to promote disposability and obviate the need for separate closure devices.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
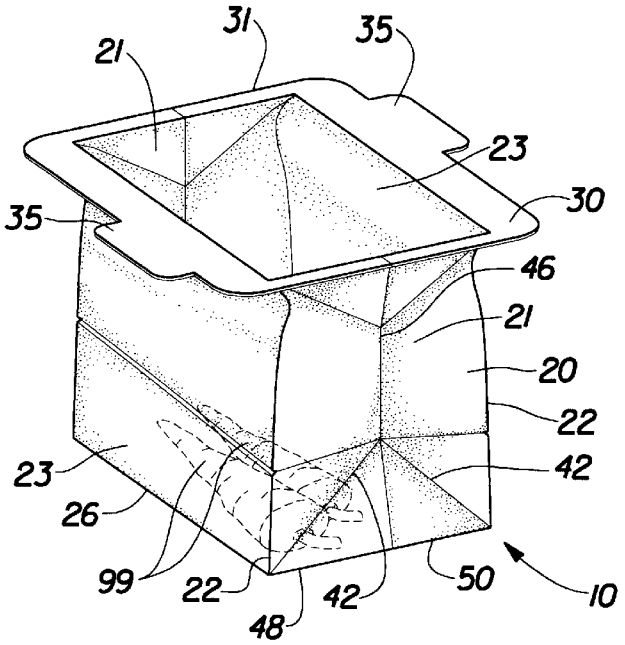
FIG. 1 is a perspective view of a preferred embodiment of a flexible storage bag of the present invention, in an open configuration.
Figure 3:
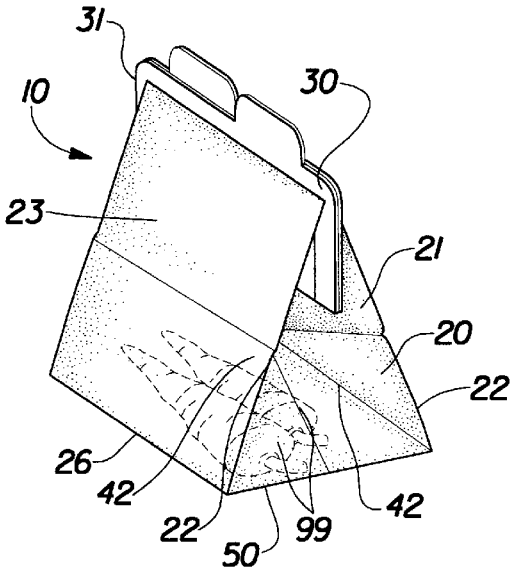
FIG. 3 is a perspective view of the flexible storage bag of FIG. 1 in a closed and sealed condition after filling.

FIG. 1 depicts a presently preferred embodiment of a flexible storage bag 10 according to the present invention. In the embodiment depicted in FIG. 1, the flexible storage bag 10 includes a bag body 20 formed from a piece of flexible sheet material folded and bonded to itself to form a semi-enclosed container having an opening defined by flange 31. Flexible storage bag 10 also includes closure means 30 associated with flange 31 for sealing the open end of the container 10 to form a fully-enclosed container or vessel as shown in FIG. 3. Closure means 30 is selectively openable, sealable, and resealable, as will be described hereinafter.

In the preferred configuration depicted in FIG. 1, the closure means 30 completely encircles the periphery of the opening formed by flange 31. However, under some circumstances a closure means formed by a lesser degree of encirclement (such as, for example, a closure means disposed along only one side of flange 31) may provide adequate closure integrity. The flange 31 may be either unitarily formed with the bag body 20 or provided as a separate material element joined to the bag body. When provided as a separate, preferably more rigid material element, it is presently preferred that the bag body material be formed into at least a small peripheral flange at its upper edge (defining the opening) with pleated corners so as to form a suitable junction point for joining the bag body to the flange.

Flexible storage bag 10 is suitable for containing and protecting a wide variety of materials and/or objects contained within the bag body. FIG. 1 depicts the storage bag 10 in an open condition wherein the closure means 30 has been released such that flange 31 may be opened to admit materials and/or objects into the interior of the bag body portion of the storage bag 10. In FIG. 1 a plurality of generic solid objects 99 are shown within the storage bag 10.

While the flexible storage bag described above with regard to FIG. 1 provides many advantages compared with flexible storage bags and storage containers commonly available, it also includes additional features to enable the bag to assume a self-supporting configuration to facilitate product access and product filling without manual support for greater ease of use.

As utilized herein, the term "self-supporting" is utilized to refer to materials, structures, or containers which are capable of maintaining their orientation in a plane parallel to the direction of the force of gravity. For example, a self-supporting material, particularly a sheet material, may be held so that it extends upwardly parallel to the direction of the force of gravity and maintain its orientation without folding over or collapsing. Non-self-supporting materials typically will fold over or collapse and not be capable of being held parallel to the force of gravity (i.e., "vertically") unless they are held so that they extend downwardly from their point of support. Correspondingly, a self-supporting bag or container is capable of maintaining its orientation with surfaces extending upwardly from their base of support in opposition to the force of gravity without folding over upon itself or collapsing.

In the preferred embodiment of FIG. 1, the flexible storage bag 10 comprises two generally planar side panels 23, two generally planar, gusseted end panels 21, and a generally planar bottom panel 50, which panels form a semi-enclosed container having an opening defined by upper flange 31. Side panels 23 include side edges 22 and bottom edges 26, while end panels 21 include bottom edges 48 and gussets of generally conventional design having converging base creases 42 and medial creases 46. In the configuration depicted in FIG. 1, the bag is in its self-supporting, open condition. Flange 31 is preferably sufficiently resilient and rigid to aid in holding the open end of the bag in an open condition as shown in FIG. 1, particularly when the hinges 32 (best seen in FIG. 2) are living hinges which resiliently bias the flange 31 toward the open configuration seen in FIG. 1. The structure of the flexible storage bag thus enables the bag to assume a self-supporting configuration to facilitate product access and product filling without manual support.

As is known in the art, gusseted bags typically provide a self-supporting open bag which may be readily filled or emptied with a minimum of difficulty. However, unlike most conventional gusseted bags the flexible storage bags of the present invention include a selectively-activatible closure means 30 as described herein. Accordingly, in addition to being self-supporting the gusseted flexible storage bags 10 also provide the desirable sealing attributes described herein.

Figure 2:
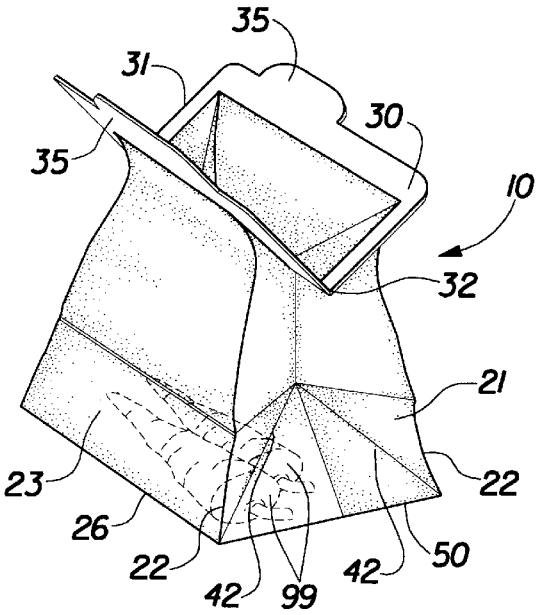
FIG. 2 is a perspective view of the flexible storage bag of FIG. 1 in a partially closed condition after filling.

FIG. 2 depicts the flexible storage bag of FIG. 1 in a partially closed condition after the objects 99 have been inserted. As shown in FIG. 2, the flange 31 preferably includes a pair of hinges 32 which are preferably unitarily formed in the material of the flange 31 as is typical of hinges commonly referred to as "living hinges". Hinges 32 are preferably configured so that they provide at least a slight biasing toward the open configuration shown in FIG. 1 to aid in holding the container in an open, self-supporting condition.

FIG. 3 depicts a flexible storage bag typical of that shown in FIG. 1, but in a sealed condition such as after insertion of a product into the interior of the bag. Accordingly, the medial creases 46 of the gussets have been pushed inwardly from the configuration of FIG. 1 in a manner similar to that of FIG. 2. However, the closure means 30 has been subjected to activation by a user so that overlying superimposed regions of the closure means are adhesively bonded to one another to form a secure, substantially fluid- and vapor-impervious seal for the opening formed by the flange 31 of the bag. In the preferred configuration shown in FIG. 1, the closure means entirely encircles the open end of the bag defined by the flange 31 so that complete adhesion of the entire periphery is assured upon activation.

As will become apparent by viewing the sequence of steps depicted in FIGS. 1–3, the flexible sheet material utilized to form the body of the bag is sufficiently flexible and yieldable to accommodate the motion of the hinged flange as it moves between the open configuration of FIG. 1 and the closed configuration of FIG. 3. More particularly, the end panels 21 are sufficiently flexible to fold or pleat upon themselves as the hinge portion of the flange pivots downwardly toward the bottom panel 50 while the outer portions of the flange (near tabs 35) move upwardly toward one another.

The illustrations of FIGS. 1–3 also demonstrate another inherent performance advantage of the flexible storage bags of the present invention. More particularly, the hinged peripheral flange orients the closure means 30 in a direction perpendicular to the axis of the opening of the flexible storage bag and perpendicular to the inner wall surfaces adjacent to the flange. This orientation tends to isolate the closure means from the materials being inserted into the bag through the opening and prevent contamination thereof before use. At the same time, closure of the bag brings the closure means through a 90 degree transition from horizontal to vertical, from perpendicular to the axis of the opening to parallel to the axis of the opening, effectively transitioning closure of the flexible storage bag from that of a container-like device to that of a bag-like device, combining the advantages of both in doing so.

To open the bag of FIG. 3, a user may grasp the pair of tabs 35 and pull them in laterally opposite directions to initiate and propagate separation of the opposed halves of flange 31, and hence closure means 30. Alternatively, marginal edges (which as mentioned above are preferably partially adhesive-free) of the bag above the closure means may be grasped and pulled apart.

Figure 4:
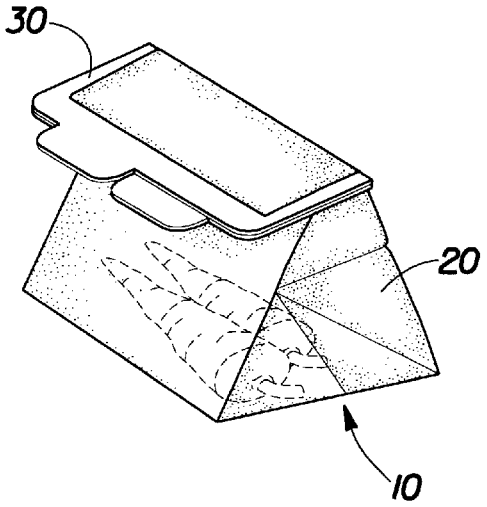
FIG. 4 is a perspective view of the flexible storage bag of FIG. 1 with the sealed edge of the bag being optionally folded over to provide a flat upper surface for stacking.

FIG. 4 depicts the closed and sealed bag of FIG. 3 with the top portion optionally folded over substantially parallel to the bottom 50, so that a stable stackable configuration is obtained whereupon other containers, articles, or the like may be stably placed upon the bag. Again, the flexible nature of the material of the bag body makes such a folding-over a viable option for efficient storage. The gusseted, pleated sidewall structure with spaced, defined corners adds additional integrity and stability to the filled bag, improving stackability in use and adding stability as well in terms of overturning or the like.

Figure 5:
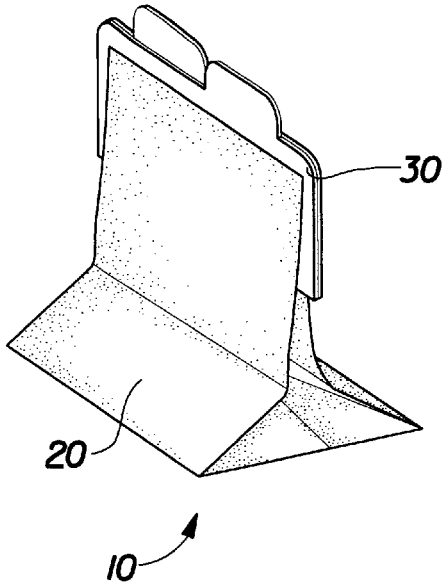
FIG. 5 is a perspective view of the flexible storage bag of FIG. 1 in a partially folded condition.
Figure 6:
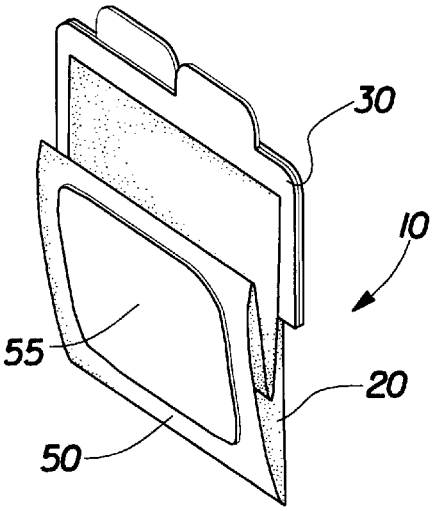
FIG. 6 is a perspective view of the flexible storage bag of FIG. 1 in a fully-folded, flattened condition.

In addition to being self-supporting, gusseted flexible storage bags 10 are also readily foldable or collapsible to provide easy storage occupying minimal space. FIG. 5 depicts a gusseted flexible storage bag 10 as shown in FIG. 1 but in a partially folded or collapsed condition. Accordingly, medial creases 46 have been pushed inwardly toward one another, bringing side edges 22 toward one another on opposite sides of the medial creases 46 and somewhat parallel to the base creases 42 in their vicinity. Such a predictable folding feature independent of the closure means also permits the volume of the container to be diminished after the contents are inserted to minimize the amount of air and/or free space above or around the contents which is trapped within the bag after closure to minimize storage space of filled bags and to aid the effectiveness of the bag in preservation of perishable items. FIG. 6 shows a gusseted flexible storage bag 10 in a more fully folded condition wherein folding continues until the bottom 50 is substantially parallel with the sides. Also depicted in FIG. 6 is the optional reinforcing panel 55 which adds additional integrity and stability to the generally rectangular, planar bottom panel 50.

Figure 7:
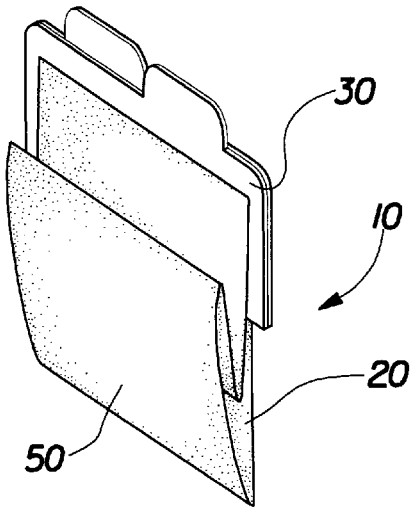
FIG. 7 is a perspective view similar to FIG. 6 of an alternative flexible storage bag having no reinforcing panel.
Figure 8:
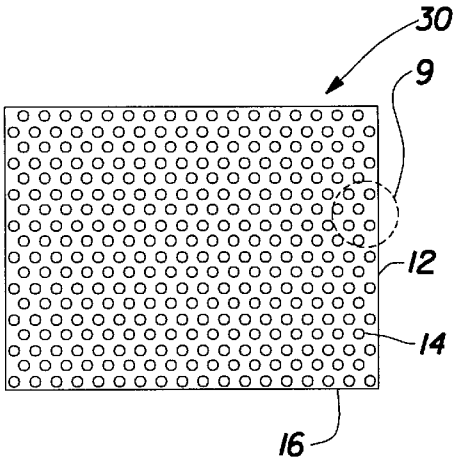
FIG. 8 is a top plan view of a preferred embodiment of a material suitable for use as a closure means of the present invention, disclosing a piece of material having truncated conical protrusions surrounded by an interconnected pattern of substance.
Figure 9:
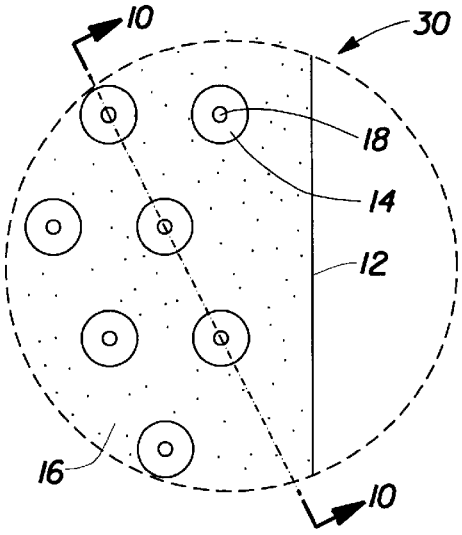
FIG. 9 is an enlarged partial top plan view of the material of FIG. 8, showing an array of protrusions.

The addition of additional reinforcement to the bottom panel lowers the center of gravity of the empty bag for greater stability prior to and during filling, increases the stiffness of the bottom of the bag for added stability in most circumstances filled or empty, and reduces the likelihood of the bottom of the bag bowing when filled with heavier contents. The inward folding of the flaps forming the bottom panel 50 of the bag body as shown in FIG. 7 also performs a similar role. The reinforcing panel may be of a similar material to the bag material or may be of a different more or less durable material, and is secured to the bottom panel by adhesive application or other suitable means. It is presently preferred that when a reinforcing panel is employed that it be placed on the exterior surface of the bottom panel rather than on the interior surface in order to provide support and reinforcement without adding additional surfaces, joints, and crevices on the interior of the bag where they may provide sites for trapping portions of the bag contents and creating cleaning difficulties.

FIG. 7 depicts a bag similar to that of FIG. 6, but without the optional reinforcing panel on the bottom 50. In FIG. 7, therefore, the seam and folding structure of the bottom 50 is clearly visible. Such a folding configuration is typical of conventional folded, gusseted bags having a square or rectangular bottom and is sealed appropriately by adhesives, heat seals, or the like so as to provide a substantially liquid-tight and gas-tight bottom structure.

Various compositions suitable for constructing the flexible storage bags of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance. Materials found suitable for use in accordance with the present invention include a low density polyethylene film, 0.004 or 0.006 inch thickness, commercially available from Huntsman Film Products Corp. under the manufacturer's designation X420.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat or adhesive sealing technologies may be utilized to join various components or elements of the bag to themselves or to each other. In addition, the bag bodies may be thermoformed, blown, or otherwise molded rather than reliance upon folding and bonding techniques to construct the bag bodies from a web or sheet of material.

The closure means depicted in FIGS. 1–7 may be constructed in any known fashion utilizing any closure configuration, such as folds, pleats, adhesives, or mechanical interlocking closures such as ribs, beads, and grooves, which are known in the art. However, it is presently preferred to utilize a selectively activatible adhesive-bearing structure which provides a secure closure seal upon activation. Accordingly, the closure means preferably comprises a selectively activatible adhesive-like material which bonds opposing material surfaces to one another across the opening formed by flange 31 in FIG. 1. The bond between the closure means and a target surface is also sufficient to provide a barrier seal against transmission of oxygen, moisture/moisture vapor, odor, etc. such that perishable items may be satisfactorily enclosed and preserved to the extent of the barrier properties of the material itself. The target surface may comprise a separate element of the bag or may comprise another region of the closure means itself.

As utilized herein, the term "selectively activatible" is used to refer to materials which exhibit substantially non-adherent properties when brought into contact with target surfaces until some action is taken by a user to "activate" the material to reveal adhesive properties. Accordingly, selectively-activatible properties differ from permanently-active strips of adhesive which rely upon removal of liner materials (typically silicone-coated paper strips) to expose the adhesive for use.

Selective activation of such materials allows the user to properly position opposing surfaces before activation and adhesion are accomplished, as well as minimizing the likelihood of contamination of the closure means by bag contents during filling operations. This characteristic permits the flexible storage bag to be opened, filled, and/or manipulated in any desired mode without encountering the difficulties of premature clinging or adhering of the closure means to itself or to other portions of the opening or bag body, and without the need for separate release sheets, liners, spacers, or the like. Preferably, the selective activation process is reversible such that the closure means may be de-activated and the bag opened for filling or removal of contents and then re-activated for further closure without significant loss of adhesive capability.

Although material utilized for the closure means may be provided with two active sides or surfaces, if desired for particular applications, in accordance with the present invention it is presently preferred to provide such material with only one active side and one inactive or inert side. While under some circumstances it may be acceptable or desirable to design the closure material so as to form a discontinuous bond pattern with itself or another target surface, such as by having an intermittent or discontinuous layer of adhesive on its active surface, it is presently preferred that the closure material be designed so as to exhibit the ability to form a continuous seal or bond with itself and with any sufficiently continuous target surface.

Various means of activation are envisioned as being within the scope of the present invention, such as: mechanical activation by compression, mechanical activation by tensile forces, and thermal activation. However, it is envisioned that there may be or be developed other means of activation which would trigger an adhesive or adhesive-like character which would be capable of functioning as herein described. In a preferred embodiment the active side is activatible by an externally applied force exerted upon the sheet of material. The force may be an externally applied compressive force exerted in a direction substantially normal to the sheet of material, an externally applied tensile force exerted in a direction substantially parallel to the sheet of material, or a combination thereof.

Regardless of the manner of activation, materials useful as a closure means in accordance with the present invention will exhibit an adhesive, adherent, or tacking character as opposed to merely a clinging or affinity character. As utilized herein, therefore, the term "adhesive" is utilized to refer the ability of a material to exhibit an adherent character whether or not it actually includes a composition commonly understood and labelled as an adhesive. Accordingly, such materials will form a bond or seal when in contact with itself or another target surface as opposed to merely being attracted to such surface. While a number of approaches such as the use of selectively adherent materials may be utilized to provide the desired adhesive properties, a presently preferred approach is to utilize a pressure-sensitive adhesive.

When designing materials useful as a closure means in accordance with the present invention, it may be desirable to tailor the particular choice of adhesive agent so as to provide either a permanent bond or a releasable bond as desired for a particular application. Where a permanent bond is desired, opening of the flexible storage bag for access to the item(s) therein requires destruction of the bag. Releasable bonds, on the other hand, provide access by permitting separation of the closure means from itself or other portions of the bag at the bond site without destruction. Moreover, depending upon the activation mechanism employed in the design of the material, the releasable bond may additionally be refastenable if sufficient adhesive character remains after the initial activation/bonding/release cycle.

The closure materials useful in the present invention exhibit an adhesion sufficient to survive the likely degree of handling and external or internal forces the flexible storage bag is likely to encounter in use while maintaining the desired level of sealing engagement with the opposing surface such that preservation of perishable items is ensured. In general, minimum adhesion which maintains a seal is desired for a closure means, so that the closure means easily peeled open for access to the stored item(s). At the same time, in a preferred embodiment the closure means is a substantially clingless material. Suitable methods of measuring and quantifying adhesive and cling properties are described in greater detail in commonly-assigned, co-pending U.S. patent application Ser. No. 08/744,850, filed Nov. 8, 1996 in the names of Hamilton and McGuire, entitled "Material Having A Substance Protected by Deformable Standoffs and Method of Making", the disclosure of which is hereby incorporated herein by reference.

The closure means utilized in accordance with the present invention comprises a sheet of material having a first side and a second side. The first side comprises an active side exhibiting an adhesion peel force after activation by a user which is greater than an adhesion peel force exhibited prior to activation by a user. The active side of the closure means preferably exhibits an adhesion peel force of at least about 1 ounce per linear inch, more preferably between about 1 and about 2.5 ounces per linear inch, after activation by a user.

One such material of current interest for use as a closure material in accordance with the present invention comprises a three-dimensional, conformable web comprising an active substance such as adhesive on at least one surface protected from external contact by the three-dimensional surface topography of the base material. Such materials comprise a polymeric or other sheet material which is embossed/debossed to form a pattern of raised "dimples" on at least one surface which serve as stand-offs to prevent an adhesive therebetween from contacting external surfaces until the stand-offs are deformed to render the structure more two-dimensional. Representative adhesive carrier structures include those disclosed in commonly assigned, co-pending U.S. patent application Ser. Nos. 08/584,638, filed Jan. 10, 1996 in the names of Hamilton and McGuire, entitled "Composite Material Releasably Sealable to a Target Surface When Pressed Thereagainst and Method of Making", 08/744,850, filed Nov. 8, 1996 in the names of Hamilton and McGuire entitled "Material Having A Substance Protected by Deformable Standoffs and Method of Making", 08/745,339, filed Nov. 8, 1996 in the names of McGuire, Tweddell, and Hamilton, entitled "Three-Dimensional, Nesting-Resistant Sheet Materials and Method and Apparatus for Making Same", 08/745,340, filed Nov. 8, 1996 in the names of Hamilton and McGuire, entitled "Improved Storage Wrap Materials". The disclosures of each of these applications are hereby incorporated herein by reference.

The three-dimensional structure comprises a piece of deformable material which has a first side formed to have a plurality of hollow protrusions separated by valleys. The plurality of hollow protrusions have outermost ends. The piece of material has a second side. The second side has a plurality of depressions therein corresponding to the plurality of hollow protrusions on the first side. The substance adheres to and partially fills the valleys between the plurality of hollow protrusions. The substance has a surface below the outermost ends of the plurality of hollow protrusions, so that when a portion of the first side of the piece of deformable film is placed against a target surface, the plurality of hollow protrusions prevent contact between the substance and the target surface until the portion is deformed at the target surface. Preferably, the plurality of protrusions deform by modes which are selected from the group consisting of inverting, crushing, and elongating. Preferably, in the inverting and/or crushing modes, each of the plurality of protrusions will not substantially deform until exposed to a pressure of at least 0.1 pounds per square inch (0.69 kPa).

FIGS. 8–12 illustrate a preferred embodiment of a material useful as a closure means for flexible storage bags according to the present invention, which comprises a three-dimensional sheet-like structure generally indicated as 30. Material 30 includes a deformed material 12 having hollow protrusions 14 and a layer of substance 16 located between protrusions 14. Protrusions 14 are preferably conical in shape with truncated or domed outermost ends 18. Protrusions 14 are preferably equally spaced in an equilateral triangular pattern, all extending from the same side of the material. Protrusions 14 are preferably spaced center to center a distance of approximately two protrusion base diameters or closer, in order to minimize the volume of valleys between protrusions and hence the amount of substance located between them. Preferably, the protrusions 14 have heights which are less than their diameters, so that when they deform, they deform by substantially inverting and/or crushing along an axis which is substantially perpendicular to a plane of the material. This protrusion shape and mode of deforming discourages protrusions 14 from folding over in a direction parallel to a plane of the material so that the protrusions cannot block substance between them from contact with a target surface.

Figure 10:
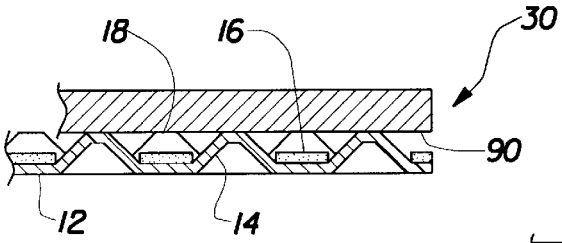
FIG. 10 is an elevational sectional view, taken along section line 10—10 of FIG. 9, showing the protrusions acting as standoffs for a substance layer between protrusions, such that a target surface contacting the outermost ends of the protrusions does not contact the substance layer.
Figure 11:
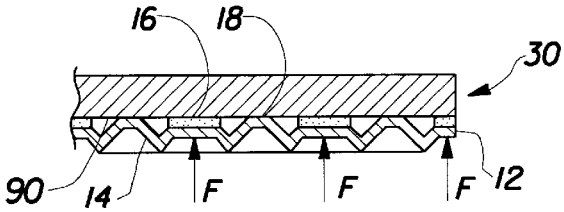
FIG. 11 is an elevational sectional view similar to FIG. 10, showing the effect of pressing the material against the target surface, such that protrusions deform by substantially inverting and/or crushing to allow the substance layer between protrusions to contact the target surface.

FIG. 10 shows a target surface 90, which is smooth but which may have any surface topography, being spaced away from layer of substance 16 by outermost ends 18 of protrusions 14. Target surfaces in accordance with the present invention will typically comprise an opposing portion of the closure periphery which may or may not itself comprise a selectively-activatible adhesive-carrying closure means of similar type. FIG. 11 shows target surface 90 contacting layer of substance 16 after protrusions 14 have been partially deformed under pressure applied to the non-substance side of material 12, as indicated by force F.

The more protrusions per unit area, the thinner the piece of material and protrusion walls can be in order to resist a given deformation force. Preferred layer of substance 16 is preferably a latex pressure sensitive adhesive or a hot melt adhesive, such as that available under specification no. Fuller HL-2115X, made by H. B. Fuller Co. of Vadnais Heights, Minn. Any adhesive can be used which suits the needs of the material application. Adhesives may be refastenable, releasable, permanent, or otherwise. The size and spacing of protrusions is preferably selected to provide a continuous adhesive path surrounding protrusions so that air-tight seals may be made with a target surface and a desired level of adhesion with a target surface, while also providing the optimum pattern of standoffs for selective activation.

Film materials may be made from homogeneous resins or blends thereof. Single or multiple layers within the film structure are contemplated, whether co-extruded, extrusion-coated, laminated or combined by other known means. The key attribute of the film material is that it be formable to produce protrusions and valleys. Useful resins include polyethylene, polypropylene, PET, PVC, PVDC, latex structures, nylon, etc. Polyolefins are generally preferred due to their lower cost and ease of forming. Other suitable materials include aluminum foil, coated (waxed, etc.) and uncoated paper, coated and uncoated nonwovens, scrims, meshes, wovens, nonwovens, and perforated or porous films, and combinations thereof.

Different applications for the formed closure means will dictate ideal size and density of protrusions, as well as the selection of the substances used therewith. It is believed that the protrusion size, shape and spacing, the web material properties such as flexural modulus, material stiffness, material thickness, hardness, deflection temperature as well as the forming process determine the strength of the protrusion. A "threshold" protrusion stiffness is required to prevent premature activation of the closure means due to the weight of overlaying layers of sheets or other forces, such as forces induced by shipping vibrations, mishandling, dropping and the like.

Inversion of protrusions minimizes protrusion spring back so that higher adhesion isn't necessary in order to prevent the failure of relatively weak seals. A resilient protrusion could be used, for example, where it is intended for the bond to be permanent, where aggressive adhesive overcomes spring back. Also, a resilient protrusion may be desirable where repeat use of the material is intended.

Figure 12:
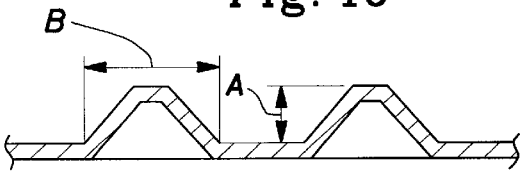
FIG. 12 is an elevational sectional view of the material of FIGS. 8–11, showing preferred dimensional relationships of protrusions.

FIG. 12 shows a preferred shape of the protrusions and valleys of closure means of the present invention, which enables protrusions to substantially invert and/or crush as a mode of deforming. The preferred shape minimizes protrusion fold-over and interference with substance placed in valleys between protrusions, or inside hollow protrusions, or both. Also, the preferred shape helps to ensure a repeatable, predictable) resistance to protrusion deformation. FIG. 12 shows that each protrusion is defined by a height dimension A and a base diameter dimension B. A preferred ratio of base diameter B to height A, which enables protrusions to substantially invert and/or crush without fold-over, is at least 2:1.

Figure 13:
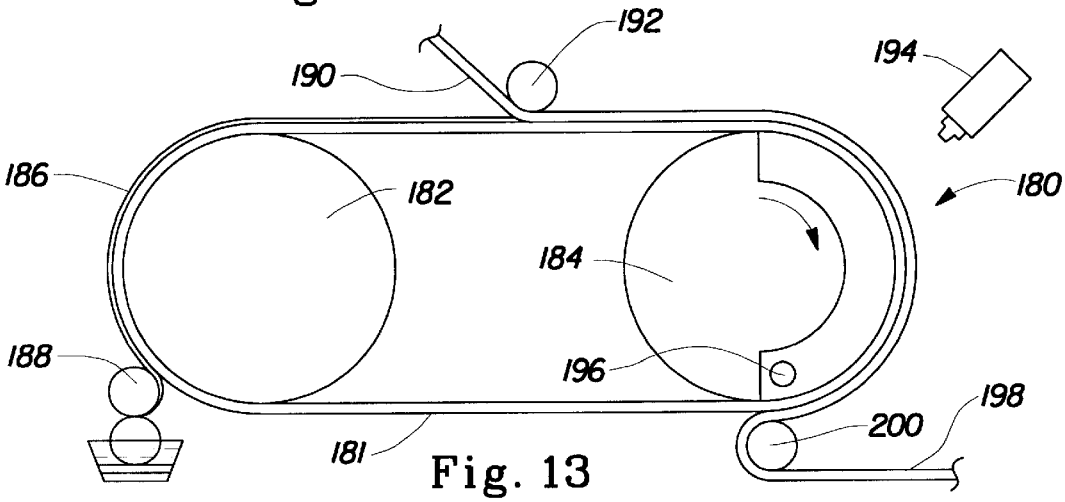
FIG. 13 is a schematic view of a suitable method of making a material suitable for use as a closure means of the present invention, showing a forming screen as a belt wrapped around a vacuum drum and a drive pulley.

FIG. 13 shows a suitable method for making a material such as the material 30 useful in accordance with the present invention, which is generally indicated as 180 in FIG. 13.

The first step comprises coating a forming screen with a first substance. The forming screen has a top surface and a plurality of recesses therein. The coating step applies the first substance to the top surface without bridging the recesses. A second step includes introducing a piece of material, which has a first side and a second side, onto the forming screen such that the first side is in contact with the first substance on the top surface of the forming screen. The first substance preferentially adheres to the first side of the piece of material. A third step includes forming the piece of material to create a plurality of hollow protrusions extending from the first side into the recesses of the forming screen. The plurality of hollow protrusions are spaced apart by valleys into which the first substance is transferred from the forming screen. The plurality of hollow protrusions are accurately registered with the first substance by use of a common transfer and forming surface. The first substance forms an interconnected layer in the valleys between the protrusions.

Forming screen 181 is threaded over idler pulley 182 and a driven vacuum roll 184. Forming screen 181 is preferably a stainless steel belt, having the desired protrusion pattern etched as recesses in the belt. Covering the outer surface of vacuum roll 184 is a seamless nickel screen which serves as a porous backing surface for forming screen 181.

For producing a pressure sensitive adhesive containing material, a substance 186, preferably hot melt adhesive, is coated onto forming screen 181 by a substance applicator 188 while forming screen 181 rotates past the applicator. A web of material 190 is brought into contact with the substance coated forming screen at material infeed idler roll 192. Hot air is directed radially at material 190 by a hot air source 194 as the material passes over vacuum roll 184 and as vacuum is applied to forming screen 181 through vacuum roll 184 via fixed vacuum manifold 196 from a vacuum source (not shown). A vacuum is applied as the material is heated by hot air source 194. A formed, substance coated material 198 is stripped from forming screen 181 at stripping roll 200. Because the same common forming screen is used to transfer the substance to the material as is used to form the protrusions, the substance pattern is conveniently registered with the protrusions.

Stainless steel forming screen 181 is a fabricated, seamed belt. It is fabricated in several steps. The recess pattern is developed by computer program and printed onto a transparency to provide a photomask for photoetching. The photomask is used to create etched and non-etched areas. The etched material is typically stainless steel, but it may also be brass, aluminum, copper, magnesium, and other materials including alloys. Additionally, the recess pattern may be etched into photosensitive polymers instead of metals. Suitable forming structures are described in greater detail in the above-referenced and above-incorporated Hamilton et al. and McGuire et al. patent applications.

Materials of the foregoing variety when utilized as a closure means in accordance with the present invention may be unitarily formed and constructed as part of the body of the flexible storage bag either before, during, or after assemblage of the bag from its material components. Alternatively, such closure means may also be separately formed and joined to the body of the flexible storage bag either before, during or after assemblage of the bag. Such joining may be edge-wise or may be accomplished as a lamination or bonding of the material facially onto a superposed portion of the bag body, such lamination being particularly advantageous when it is desired to add additional thickness, stiffness, and/or resiliency to the region of the bag comprising the closure means. The material utilized for the closure means may be the same as or different from the material utilized to form the bag body either in dimensions or in composition.

Particularly useful as a flange material in accordance with the present invention is a self-supporting, semi-rigid, resilient polymeric or coated paper sheet material with a closure means laminated thereto such that the active side of the closure means faces away from the flange material, such that a composite closure means is formed having a plurality of highly-deformable stand-offs with a substantially more resilient, more self-supporting base material. Materials found suitable for use in accordance with the present invention include a low density polyethylene sheet material, 0.020 inch thickness, commercially available from Huntsman Film Products Corp. under the manufacturer's designation X420.

To facilitate separation of adhered or bonded overlying portions of the closure means material, various adaptations or modifications may be accomplished in terms of integration of the material into the overall structure of the flexible storage bag. For example, it may be desirable to provide extension tabs (such as tabs 35 shown in FIGS. 1–7) on opposing sides of the opening periphery to facilitate manual initiation of closure separation. It may also be desirable to leave a small but finite portion of the bag body immediately adjacent to the opening periphery free of closure material, such that there is a non-adherent rim of material which may be utilized to initiate material separation and hence opening of the flexible storage bag.

In accordance with the present invention, the use of selectively-activatible adhesive materials for the closure means 30 provides the user with an easy-to-operate closure means for closing and sealing an opening in a flexible storage bag. The closure means 30 is easy to manipulate with one or two hands, as the only dexterity required is to grasp or pinch the closure means with a pair of opposed digits to activate the material against an opposing surface of the bag body or closure means. Moving the grasping digits across the extent of the opening provides secure adhesion of the closure means across the extent of the opening, thereby converting the flexible bag from a semi-enclosed container to a fully closed container. Particularly when the closure means fully encircles the opening in the bag body, the closure means 30 is highly tolerant to misalignment as it will adhere to any opposing surface unlike mechanical closure mechanisms which typically require precise alignment of mating elements.

The ability of the closure means to be activated by pinching or grasping superimposed portions of the bag body is particularly advantageous with flexible, conformable structures such as the flexible storage bags of the present invention. More particularly, such structures are yieldable under applied forces and accordingly, it would be difficult to activate a seal by exerting pressure upon the bag as a whole against a surface, particularly when filled, as such would tend to expel bag contents as sealing of the closure is attempted. Therefore, the use of a closure means as herein described permits secure, reliable sealing of even highly flexible storage bags.

Because the closure means in a preferred configuration employs a layer of adhesive protected by a plurality of three-dimensional protrusions, rather than a three-dimensional mating pair of interlocking elements, it is possible to employ such a closure means successfully in a confined, non-parallel region of the bag body such as the region near the hinges 32 without providing leakage sites such as the ends of the mechanical elements. Accordingly, the closure means 30 of the present invention provides additional security and confidence in the level of sealing obtained for situations where a leakproof seal is important.

Although the self-supporting flexible storage bags illustrated in the foregoing FIGS. 1–7 have been constructed of flexible sheet material along the lines of the approach typically taken for paper grocery-type bags, as illustrated for example in U.S. Pat. No. 584,555, issued Jun. 15, 1897 to Lorenz, a wide variety of other constructions may be utilized in keeping with the self-supporting approach in conjunction with the use of a closure means in accordance with the present invention. Examples of such other illustrative bag designs include U.S. Pat. Nos. 3,970,241, issued Jul. 20, 1976 to Hanson, 5,061,500, issued Oct. 29, 1991 to Mendenhall, 5,195,829, issued Mar. 23, 1993 to Watkins et al., and 5,314,252, issued May 24, 1994 to Happ. Also illustrative is commonly-assigned U.S. Pat. No. 4,898,477, issued Feb. 6, 1990 to Cox et al., the disclosure of which is hereby incorporated herein by reference.

In addition to such use of sheet material folded and sealed to form the bag body, the bag may be constructed in any known and suitable fashion such as those known in the art for making such bags in commercially available form. Heat or adhesive sealing technologies may be utilized to join various components or elements of the bag to themselves or to each other. In addition, the bag bodies may be thermoformed, blown, or otherwise molded from a starting blank or sheet of material rather than reliance upon folding and bonding techniques to construct the bag bodies from a web or sheet of material.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible storage bag comprising at least one sheet of flexible sheet material assembled to form a semi-enclosed container having two opposing side panels, two opposing gusseted end panels between said side panels, an opening defined by a hinged peripheral flange, and a substantially planar bottom opposite of and substantially parallel to said opening, said end panels each including a gusset extending in a direction normal to said opening, said hinged flange including a closure, said closure being selectively activatable without removal of a liner material for sealing said opening to convert said semi-enclosed container to a closed container, said closure comprising a three-dimensional sheet material having a plurality of protrusions separated by valleys, said three-dimensional sheet material being convertible to a substantially two-dimensional sheet material upon collapse of said protrusions in response to an externally applied compressive force exerted by a user to expose an adhesive layer to contact a complementary surface, wherein said side panels, said end panels, said bottom, and said hinged flange form a structure which enables said container to be self-supporting and maintains said opening in an upwardly-extending condition when said bottom is placed on a horizontal surface.

2. The flexible storage bag of claim 1, wherein said bag maintains said opening in a substantially open condition.

3. The flexible storage bag of claim 1, wherein said closure means comprises a piece of material forming at least a portion of said hinged flange, said piece of material having a first side facing inwardly toward said opening and a second side facing outwardly of said opening, said first side exhibiting an adhesion peel force after activation by a user which is greater than an adhesion peel force exhibited prior to activation by a user.

4. The flexible storage bag of claim 1, wherein said flange is unitarily formed and includes an opposed pair of living hinges.

5. The flexible storage bag of claim 4, wherein said living hinges bias said flange such that said opening is maintained in a substantially open condition.

6. The flexible storage bag of claim 1, wherein said flange includes an opposed pair of hinges aligned with said gussets.

7. The flexible storage bag of claim 1, wherein said closure means is activatible by an externally applied force exerted upon said piece of material.

8. The flexible storage bag of claim 7, wherein said closure means is activatible by an externally applied compressive force exerted in a direction substantially parallel to a plane defined by said opening.

9. The flexible storage bag of claim 1, wherein said piece of material forms substantially all of said periphery.

10. The flexible storage bag of claim 1, wherein said closure means is unitarily formed from said sheet material.

11. The flexible storage bag of claim 1, wherein said closure means comprises a separate material element joined to said sheet material.

12. The flexible storage bag of claim 1, wherein said hinged flange rotates said closure means from a position substantially normal to a plane of said opening in an open configuration to a position substantially parallel to a plane of said opening in a closed configuration.

13. The flexible storage bag of claim 1, wherein opposed portions of said flange include tabs for initiating opening of said closure means.

14. The flexible storage bag of claim 1, wherein said flange is unitarily formed with said sheet material.

15. The flexible storage bag of claim 1, wherein said closure means comprises a piece of material forming at least a portion of said hinged flange, said piece of material having a first side facing inwardly toward said opening and a second side facing outwardly of said opening, said first side exhibiting an adhesion peel force after activation by a user which is greater than an adhesion peel force exhibited prior to activation by a user.

* * * * *